US005160841A

United States Patent [19]

Chapman et al.

[11] Patent Number: 5,160,841

[45] Date of Patent: Nov. 3, 1992

[54] ION SOURCE FOR A MASS SPECTROMETER

[75] Inventors: John R. Chapman; David S. Jones, both of Cheshire, United Kingdom

[73] Assignee: Kratos Analytical Limited, Urmston, Manchester, England

[21] Appl. No.: 805,570

[22] Filed: Dec. 12, 1991

[30] Foreign Application Priority Data

Dec. 12, 1990 [GB] United Kingdom ..... 9026962

[51] Int. Cl.[5] ..... H01J 49/04

[52] U.S. Cl. ..... 250/288; 250/281; 250/423 R

[58] Field of Search ..... 250/288 R, 288 A, 281, 250/282, 423 R, 423 P, 425

[56] References Cited

U.S. PATENT DOCUMENTS 4,214,159 7/1980 Hillenkamp et al. ..... 250/288
4,296,322 10/1981 Wechsung ..... 250/282
4,562,351 12/1985 Atherton et al. ..... 250/288
4,794,253 12/1988 Kobayashi ..... 250/288
4,810,878 7/1989 Kobayashi ..... 250/288
4,818,863 4/1989 Kobayashi et al. ..... 250/288
4,820,648 11/1989 Caprioli et al. ..... 250/288
4,908,512 3/1990 Caprioli ..... 250/288

FOREIGN PATENT DOCUMENTS 2202671B 9/1988 United Kingdom .
2205196A 11/1988 United Kingdom .
2217514A 10/1989 United Kingdom .

*Primary Examiner*—Jack I. Berman
*Assistant Examiner*—Kiet T. Nguyen
*Attorney, Agent, or Firm*—Leydig, Voit & Mayer

[57] ABSTRACT

An ion source for a mass spectrometer has a continuous flow probe (FIG. 2) having a mesh defining a surface, a capillary for supplying liquid sample to the surface and a porous body disposed at the periphery of the mesh. An ion source generates a beam of ionising radiation to which sample supplied to the surface is exposed. Sample supplied by the inlet tube spreads across the surface and surplus sample reaching the periphery of the mesh is absorbed by the porous body.

13 Claims, 2 Drawing Sheets

ION SOURCE FOR A MASS SPECTROMETER

FIELD OF THE INVENTION

This invention relates to an ion source for a mass spectrometer and particularly, though not exclusively, an ion source employing fast atom bombardment (FAB); that is, an ion source wherein ions are produced by bombarding a sample with a beam of neutral particles. The invention also relates to an ion source for use in liquid secondary ion mass spectrometry (LSIMS) wherein ions are produced by bombarding a sample with a beam of ions.

BACKGROUND OF THE INVENTION

A known form of ion source incorporates a so-called continuous flow probe which enables liquid sample, from a liquid chromatograph, for example, to be supplied continuously to a surface at the probe tip for bombardment with a beam of ionising particles or radiation. A problem associated with some probe designs stems from the tendency for sample to accumulate at the surface; in such circumstances, it is possible that different sample components, supplied to the surface of the probe tip at different times, might be ionised simultaneously. This phenomenon, known as memory effect, could compromise the reliability of the measurements being made, particularly if those measurements require knowledge of the relative times at which different sample components are produced, as would be the case if the associated mass spectrometer is being used to analyse the effluent from a liquid chromatograph or the time profile of a chemical reaction.

SUMMARY OF THE INVENTION

According to a first aspect of the invention there is provided an ion source for a mass spectrometer, comprising a continuous flow probe and means for producing a beam of ionising radiation or particles, wherein the continuous flow probe comprises means defining a surface so located in relation to the beam producing means as to be exposed to the ionising radiation or particles, an inlet tube for continuously supplying liquid sample to said surface for exposure to the ionising radiation or particles, a porous body disposed at the periphery of said surface and being absorbent of sample that has spread to the periphery after being supplied to the surface by the inlet tube, and means for shielding the porous body from exposure to the ionising radiation or particles.

The porous body, which could be made from a metal alloy, serves to absorb excess sample thereby preventing the accumulation of sample at the surface, and the shield means prevents sample which has been absorbed by the material of the porous body from being exposed to the ionising radiation or particles. Accordingly, an ion source according to the invention is substantially free from the afore-mentioned memory effect.

In a preferred embodiment the means defining said surface is a metal (e.g. stainless steel) mesh, and the porous body may comprise a cylindrical side wall and an end wall, the end wall having an aperture in which the mesh is located.

Alternatively, the porous body may comprise a cylinder and the mesh is located adjacent an end face of the porous body, preferably trapped between said end face and the shielding means. This arrangement assists replacement of the mesh should it become blocked.

The ion source may include heater means for causing evaporation of liquid sample absorbed by the porous body, and the heater means may be so disposed in relation to the porous body as to promote a flow of absorbed sample away from said surface.

According to a further aspect of the invention, there is provided a mass spectrometer incorporating an ion source as defined in accordance with said first aspect of the invention.

According to a yet further aspect of the invention, there is provided a continuous flow probe for use in the ion source defined in accordance with said first aspect of the invention.

DESCRIPTION OF THE DRAWINGS

An ion source in accordance with the invention is now described, by way of example only, with reference to the accompanying drawings, in which.

DESCRIPTION OF THE PREFERRED EMBODIMENTS

Figure 1:
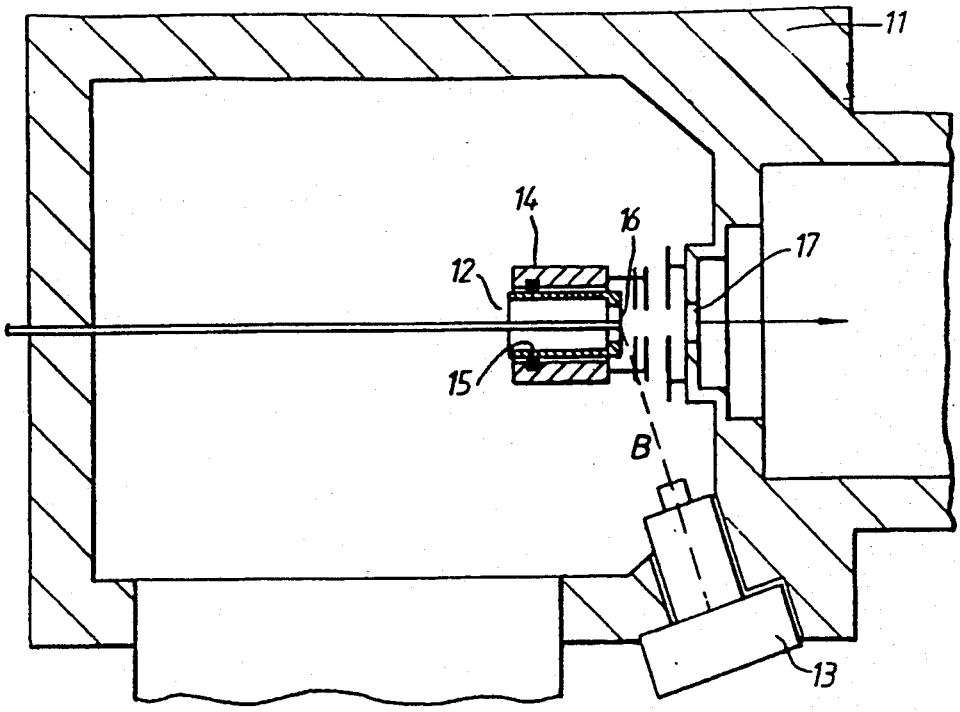
FIG. 1 is a schematic diagram of the ion source.

FIG. 1 shows an ion source utilising fast atom bombardment.

Referring to FIG. 1, the ion source comprises a housing 11, the inside of which is evacuated by means of a vacuum pump (not shown). The housing is fitted with a continuous flow probe 12 and a source 13 of ionising radiation or particles. An ionisation chamber 14 provided within the housing is in thermal and electrical contact with the probe at the position 15 in the drawing, towards the rear of the probe. The ionisation chamber also incorporates a heater (not shown).

The ion source 13 generates a beam B of neutral particles.

The continuous flow probe 12 defines a surface 16 to which liquid sample is continuously supplied, and source 13 directs the primary ionising beam B onto the sample causing the production of secondary ions by sputtering. Secondary ions produced in this way are then accelerated by a suitable electrostatic field and are drawn into a mass analyser (not shown) via an outlet opening 17 in a wall of the source housing.

Figure 2A:
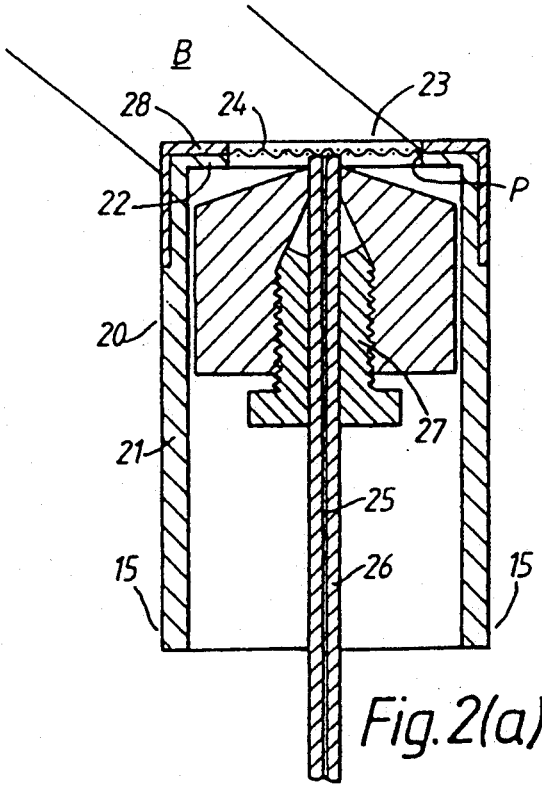
FIG. 2*a* is an enlarged, cross-sectional view through one embodiment of a continuous flow probe of the ion source shown in FIG. 1.
Figure 2B:
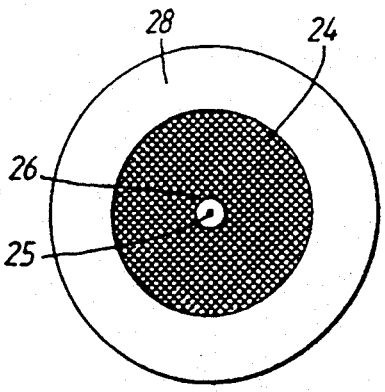
FIG. 2*b* is an end view of the probe shown in FIG. 2*a*.

Referring now to FIGS. 2(*a*) and 2(*b*), the continuous flow probe comprises a porous body 20 made from an alloy, by sintering powdered stainless steel, for example. Alternatively, the porous body 20 could be made from a sintered element such as silver or carbon. The body 20 has a cylindrical side wall 21 and an end wall 22 formed with a central opening 23 into which a thin, close-weave stainless steel mesh 24 is fitted by spot welding.

In this embodiment of the invention the mesh is formed from longitudinal and transverse strands, 50 $\mu$m in diameter, having a centre-to-centre separation of about 110 $\mu$m.

The mesh provides the afore-mentioned surface 16 which is supplied continuously with liquid sample for exposure to the primary ionising beam B.

Liquid sample, containing solvent and sample components under investigation, is supplied to surface 16 via an inlet tube 25, whose open end bears against mesh 24. The inlet tube comprises a fused silica capillary (i.d. 50 μm) sheathed by protective PTFE tubing 26 and is fixed in place by a compression fitting 27.

Liquid sample supplied to the mesh is caused by surface forces to spread outwardly across surface 16, where the sample is exposed to the ionising beam B, and surplus sample reaching the periphery P of the mesh is absorbed by the porous body 20.

Heat from the heater of the ionisation chamber 14 is conducted to the rear of the probe at position 15, promotes evaporation of absorbed sample and, in effect, establishes a driving force encouraging sample to flow away from end wall 22 and the adjacent surface 16.

The continuous movement of sample across surface 16, and the subsequent absorption of surplus sample by the porous body 20, prevents an undesirable accumulation of sample on the mesh and ensures that only freshly supplied sample will be exposed to the ionising beam B.

A stainless steel shield 28 covering end surfaces of body 20 prevents exposure to the ionising beam of stale sample, which has already been absorbed within the body. Accordingly, the described probe substantially eliminates memory effect and band broadening signals that would otherwise by produced.

Figure 3:
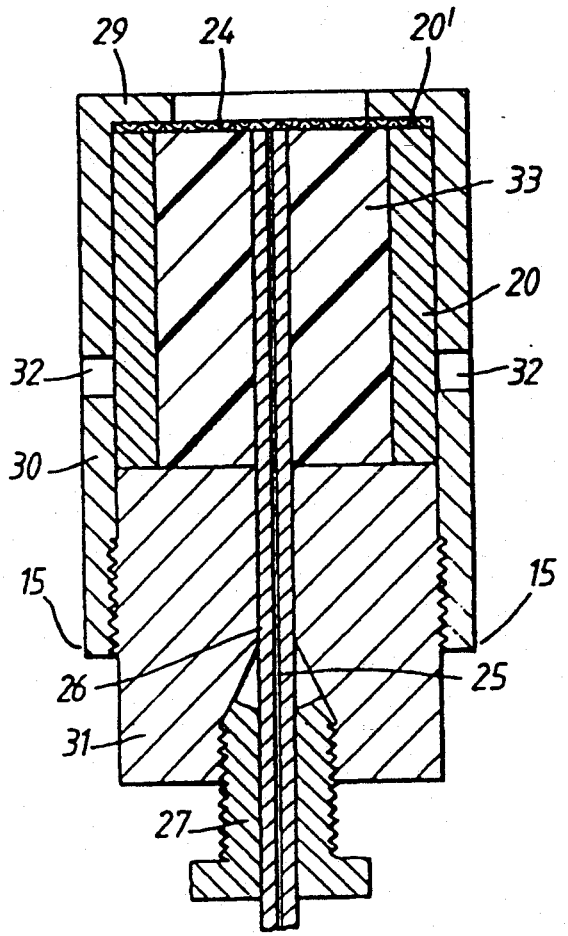
FIG. 3 is an enlarged, cross-sectional view through another embodiment of a continuous flow probe of the ion source shown in FIG. 1.

Referring now to FIG. 3, component parts that are common to FIGS. 2(*a*) and 2(*b*) are ascribed like reference numerals.

In this embodiment, porous body 20 has the form of a cylinder. The stainless steel mesh 24 is not attached to the porous body by spot welding, as in the embodiment of FIGS. 2(*a*) and 2(*b*), but is trapped between an end face 20' of the porous body and an end wall 29 of a cylindrical support member 30 made from stainless steel. The mesh is trapped between these parts by screwing a threaded body 31 into the open end of the support member, and this arrangement has the advantage that the mesh can be easily replaced should it become blocked. The cylindrical support member 30, which serves as the shield (referenced 28 in FIG. 2(*a*)), is provided with circumferentially disposed holes 32 which allow sample absorbed by the porous body to be pumped away. The space within the porous body is filled with a cylindrical body 33 made from PTFE, and the inlet tube 25 and its protective tubing 26 are held in place by the compression fitting 27.

The inlet tube 25 may be coupled to a liquid chromatograph in order to receive liquid sample in the form of effluent output thereby. It will be appreciated, however, that the ion source of the invention could be used with alternative sources of liquid sample.

Furthermore, although the described embodiments employ fast atom bombardment, alternative sources of ionising radiation or particles could be used; for example, sources of ions (for use in liquid secondary ion mass spectrometry LSIMS), electrons or photons.

We claim:

1. An ion source for a mass spectrometer, comprising a continuous flow probe and means for producing a beam of ionising radiation or particles, wherein the continuous flow probe comprises means defining a surface so located in relation to the beam producing means as to be exposed to the ionising radiation or particles, an inlet tube for continuously supplying liquid sample to said surface for exposure to the ionising radiation or particles, a porous body disposed at the periphery of said surface and being absorbent of sample that has spread to the periphery after being supplied to the surface by the inlet tube, and means for shielding the porous body from exposure to the ionising radiation or particles.

2. An ion source as claimed in claim 1, wherein said means defining the surface is a metal mesh.

3. An ion source as claimed in claim 2, wherein the mesh is made from stainless steel.

4. An ion source as claimed in claim 2, wherein the porous body comprises a cylindrical side wall and an end wall, the end wall having an aperture in which the mesh is located.

5. An ion source as claimed in claim 4, wherein the mesh is located in the aperture by spot welding to the end wall.

6. An ion source as claimed in claim 2, wherein the porous body comprises a cylinder and the mesh is located adjacent an end face of the porous body.

7. An ion source as claimed in claim 6, wherein the mesh is trapped between said end face of the porous body and the shielding means.

8. An ion source as claimed in claim 1, wherein the porous body is made from a sintered alloy.

9. An ion source as claimed in claim 1, including heater means for causing evaporation of liquid sample absorbed by the porous body.

10. An ion source as claimed in claim 9, wherein the heater means is so disposed in relation to the porous body as to promote a flow of absorbed sample away from said surface.

11. An ion source as claimed in claim 1, utilising fast atom bombardment.

12. A mass spectrometer incorporating an ion source as claimed in claim 1.

13. A continuous flow probe for an ion source having a means for producing a beam of ionizing radiation or particles comprising a means defining a surface so located in relation to the beam producing means as to be exposed to the ionizing radiation or particles, an inlet tube for continuously supplying a liquid sample to said surface for exposure to the ionizing radiation or particles, a porous body disposed at the periphery of said surface and being absorbent of sample that has spread to the periphery after being supplied to the surface of the inlet tube, and means for shielding said porous body from exposure to the ionizing radiation or particles.

* * * * *